US009581170B2

(12) United States Patent
Holbrook

(10) Patent No.: US 9,581,170 B2
(45) Date of Patent: Feb. 28, 2017

(54) METHODS OF DESIGNING AND MAKING DIFFUSER VANES IN A CENTRIFUGAL COMPRESSOR

(71) Applicant: HONEYWELL INTERNATIONAL INC., Morristown, NJ (US)

(72) Inventor: Greg Holbrook, Scottsdale, AZ (US)

(73) Assignee: HONEYWELL INTERNATIONAL INC., Morris Plains, NJ (US)

( * ) Notice: Subject to any disclaimer, the term of this patent is extended or adjusted under 35 U.S.C. 154(b) by 982 days.

(21) Appl. No.: 13/835,366

(22) Filed: Mar. 15, 2013

(65) Prior Publication Data

US 2014/0271170 A1 Sep. 18, 2014

(51) Int. Cl.
*F04D 29/30* (2006.01)
*F04D 29/44* (2006.01)

(52) U.S. Cl.
CPC ..... *F04D 29/30* (2013.01); *F04D 29/444* (2013.01); *Y10T 29/49229* (2015.01)

(58) Field of Classification Search
CPC ..... F04D 29/30; F04D 29/44; F03B 3/12
See application file for complete search history.

(56) References Cited

U.S. PATENT DOCUMENTS 382,881 A * 5/1888 Hoglund et al. ..... F16H 31/005 74/143
2,372,880 A 4/1945 Browne
2,965,287 A * 12/1960 Schug ..... F04D 29/284 29/889.7
3,481,531 A * 12/1969 MaCarthur ..... F04D 29/284 415/914
4,520,541 A * 6/1985 Miki ..... B23P 15/006 29/889.23
5,730,582 A * 3/1998 Heitmann ..... B63H 11/08 416/185
6,428,281 B1 * 8/2002 Botrel ..... F01D 5/145 416/223 A (Continued)

OTHER PUBLICATIONS

EP Examination Report for Application No. 14158997.8 dated Jan. 12, 2014.

(Continued)

*Primary Examiner* — Audrey K Bradley
*Assistant Examiner* — Shafiq Mian
(74) *Attorney, Agent, or Firm* — Lorenz & Kopf, LLP

(57) ABSTRACT

Centrifugal compressors, methods of forming centrifugal compressors, and methods of designing diffuser vanes in centrifugal compressors are provided herein. In an embodiment, a method of designing diffuser vanes includes providing an initial two-dimensional diffuser vane layout including initial diffuser vane peripheries radially spaced about an axis. The initial diffuser vane peripheries are rotated using a computer processor to produce rotated diffuser vane peripheries having offset trailing ends relative to the initial diffuser vane peripheries. The rotated diffuser vane peripheries are circumferentially shifted about the axis to produce shifted diffuser vane peripheries. Leading ends of the shifted diffuser vane peripheries are offset from the leading ends of the initial diffuser vane peripheries. Diffuser vane surfaces are generated that connect the shifted diffuser vane peripheries to the corresponding initial diffuser vane peripheries to form diffuser vanes in a twisted configuration.

17 Claims, 6 Drawing Sheets

(56) References Cited

U.S. PATENT DOCUMENTS

| | | | | |
|---|---|---|---|---|
| 6,508,630 | B2 | 1/2003 | Liu et al. | |
| 7,448,852 | B2 | 11/2008 | Abdelwahab et al. | |
| 7,510,371 | B2 * | 3/2009 | Orlando | F01D 5/141 415/191 |
| 7,909,580 | B2 * | 3/2011 | Simpson | F01D 5/141 416/223 A |
| 8,016,557 | B2 | 9/2011 | Abdelwahab et al. | |
| 8,240,976 | B1 * | 8/2012 | Kamio | F04D 29/448 415/1 |
| 2002/0141863 | A1 * | 10/2002 | Liu | F01D 5/145 415/192 |
| 2007/0036647 | A1 * | 2/2007 | Abdelwahab | F04D 29/444 415/211.2 |
| 2007/0147999 | A1 * | 6/2007 | Feher | B23P 15/006 416/186 R |
| 2008/0038114 | A1 * | 2/2008 | Abdelwahab | F04D 29/444 415/211.1 |
| 2010/0215489 | A1 * | 8/2010 | Johnson | F04D 29/444 415/208.2 |
| 2010/0272564 | A1 | 10/2010 | Richter et al. | |
| 2011/0097203 | A1 * | 4/2011 | Shibata | F04D 17/12 415/207 |
| 2011/0110784 | A1 * | 5/2011 | DeMania | F01D 5/225 416/219 R |
| 2014/0165592 | A1 * | 6/2014 | Key | F01D 5/141 60/805 |

OTHER PUBLICATIONS

EP Search Report for Application No. 14158997.8 dated Nov. 5, 2014.

EP Examination Report for Application No. 14158997.8-1607 dated Jul. 7, 2015.

EP Examination Report for Application No. 14158997.8-1607 dated Apr. 26, 2016.

* cited by examiner

METHODS OF DESIGNING AND MAKING DIFFUSER VANES IN A CENTRIFUGAL COMPRESSOR

TECHNICAL FIELD

The technical field generally relates to centrifugal compressors including a diffuser having twisted diffuser vanes and methods of forming the same, and more particularly relates to methods of designing twisted diffuser vanes for the diffuser of the centrifugal compressors.

BACKGROUND

A gas turbine engine typically includes a compressor, a combustor, and a turbine. Airflow entering the compressor is compressed and directed to the combustor where it is mixed with fuel and ignited, producing hot combustion gases used to drive the turbine. Turbine engine performance and specific fuel consumption (SFC) are directly impacted by efficiency of compressors that are employed therein. Centrifugal compressors are commonly employed as the compressors to draw in and compress air, and the centrifugal compressors are the focus of various design improvements to increase the efficiency thereof. Improvements in centrifugal efficiency can be realized through various modifications such as optimization of impeller and diffuser design, particularly focusing upon vane configurations in both the impeller and the diffuser.

The diffuser vanes generally extend between a shroud and a hub in the centrifugal compressor, with the diffuser vanes, hub, and shroud defining flow channels for air provided by the impeller. The vanes are radially spaced about an outer circumference of the impeller and are generally designed to maximize aerodynamic flow and compression of the air. Angle and shape of diffuser vanes for maximum efficiency has been widely investigated, with certain modifications to diffuser vane configuration implemented to exploit a finding that a radial component of air discharge velocity varies across a discharge end of the impeller. In particular, it has been found that velocity of air is higher adjacent to a back wall of the impeller, i.e., adjacent to the hub, than at areas axially forward of the back wall, i.e., adjacent to the shroud. A twisted vane configuration has been proposed to align the diffuser vanes in a manner that more closely matches the flow profile of air that is provided by the impeller. The twisted vane configuration results in the diffuser vanes having a different angle at the shroud and at the hub. Despite advancements in diffuser vane design and configuration, there remains an opportunity to further refine diffuser vane designs and techniques for designing the diffuser vanes to maximize efficiency of the centrifugal compressors.

Accordingly, it is desirable to provide centrifugal compressors having twisted diffuser vanes, methods of forming the centrifugal compressors, and methods of designing diffuser vanes in centrifugal compressors that exhibit maximized efficiency. Furthermore, other desirable features and characteristics of the present invention will become apparent from the subsequent detailed description of the invention and the appended claims, taken in conjunction with the accompanying drawings and this background of the invention.

BRIEF SUMMARY

Centrifugal compressors, methods of forming centrifugal compressors, and methods of designing diffuser vanes in centrifugal compressors are provided herein. In an embodiment, a method of designing diffuser vanes in a centrifugal compressor is provided, with the centrifugal compressor including a diffuser and an impeller that is concentrically rotatable relative to the diffuser about an axis. An initial two-dimensional diffuser vane layout is provided that includes initial diffuser vane peripheries that are radially spaced about the axis. The initial diffuser vane peripheries are rotated using a computer processor to produce rotated diffuser vane peripheries that have offset trailing ends relative to trailing ends of the initial diffuser vane peripheries. The rotated diffuser vane peripheries are circumferentially shifted about the axis using the computer processor to produce shifted diffuser vane peripheries. Leading ends of the shifted diffuser vane peripheries are offset from the leading ends of the initial diffuser vane peripheries. Diffuser vane surfaces are generated that connect the shifted diffuser vane peripheries to the corresponding initial diffuser vane peripheries using the computer processor to form diffuser vanes that have a twisted configuration extending from leading edges to trailing edges of the diffuser vanes.

In another embodiment, a method of forming a centrifugal compressor that includes a diffuser and an impeller includes providing an initial two-dimensional diffuser vane layout that includes initial diffuser vane peripheries that are radially spaced about an axis. The initial diffuser vane peripheries are rotated using a computer processor to produce rotated diffuser vane peripheries that have offset trailing ends relative to trailing ends of the initial diffuser vane peripheries. The rotated diffuser vane peripheries are shifted about the axis using the computer processor to produce shifted diffuser vane peripheries. Leading ends of the shifted diffuser vane peripheries are offset from the leading ends of the initial diffuser vane peripheries. Diffuser vane surfaces are generated that connect the shifted diffuser vane peripheries to the corresponding initial diffuser vane peripheries using the computer processor to form diffuser vanes that have a twisted configuration extending from leading edges to trailing edges of the diffuser vanes. The diffuser including the diffuser vanes that have the twisted configuration is formed. The diffuser and the impeller are assembled with the impeller concentrically rotatable relative to the diffuser about the axis.

In another embodiment, a centrifugal compressor includes a diffuser and an impeller that is concentrically rotatable relative to the diffuser about the axis. The diffuser includes diffuser vanes that are radially spaced about the axis. The diffuser vanes have leading edges that are proximal to the axis and trailing edges that are distal to the axis. The diffuser vanes have a twisted configuration extending from leading edges to trailing edges of the diffuser vanes. The leading edges are skewed and form less than a 90 degree angle with a radius of the diffuser.

BRIEF DESCRIPTION OF THE DRAWINGS

The various embodiments will hereinafter be described in conjunction with the following drawing figures, wherein like numerals denote like elements, and wherein.

DETAILED DESCRIPTION

The following detailed description is merely exemplary in nature and is not intended to limit the various embodiments or the application and uses thereof. Furthermore, there is no intention to be bound by any theory presented in the preceding background or the following detailed description.

Centrifugal compressors, methods of forming centrifugal compressors, and methods of designing diffuser vanes in centrifugal compressors are provided herein. The methods of designing the diffuser vanes in the centrifugal compressors enables diffuser vanes to be formed by providing an initial two-dimensional diffuser vane layout of initial diffuser vane peripheries, with the initial diffuser vane peripheries representing connections to a shroud or a hub of a diffuser in the centrifugal compressor. The two-dimensional diffuser vane layout enables modification of the initial diffuser vane peripheries to form diffuser vanes in a twisted configuration. In particular, in accordance with the method, the initial diffuser vane peripheries are rotated and shifted to produce shifted diffuser vane peripheries, with leading ends of the shifted diffuser vane peripheries offset from leading ends of the initial diffuser vane peripheries. Diffuser vane surfaces are generated that connect the shifted diffuser vane peripheries to the corresponding initial diffuser vane peripheries to form the diffuser vanes in a three-dimensional configuration, with the respective diffuser vane peripheries representing connections to the shroud or hub. Due to the offset between the leading edges of the shifted diffuser vane peripheries and the corresponding initial diffuser vane peripheries, the resulting diffuser vanes have skewed leading edges. Leading edges, as referred to herein, are edges of the diffuser vanes that are first encountered by airflow from the impeller. The "skewed" leading edges, as referred to herein, refer to leading edges that extend between the shroud and the hub and that form less than a 90 degree angle with a radius of the diffuser 12, as opposed to leading edges that are perpendicular to the shroud 27 and the hub 29. The skewed leading edges more closely align with airflow from the impeller than leading edges that are perpendicular to the shroud 27 and the hub 29, thereby providing maximized efficiency.

Figure 1:
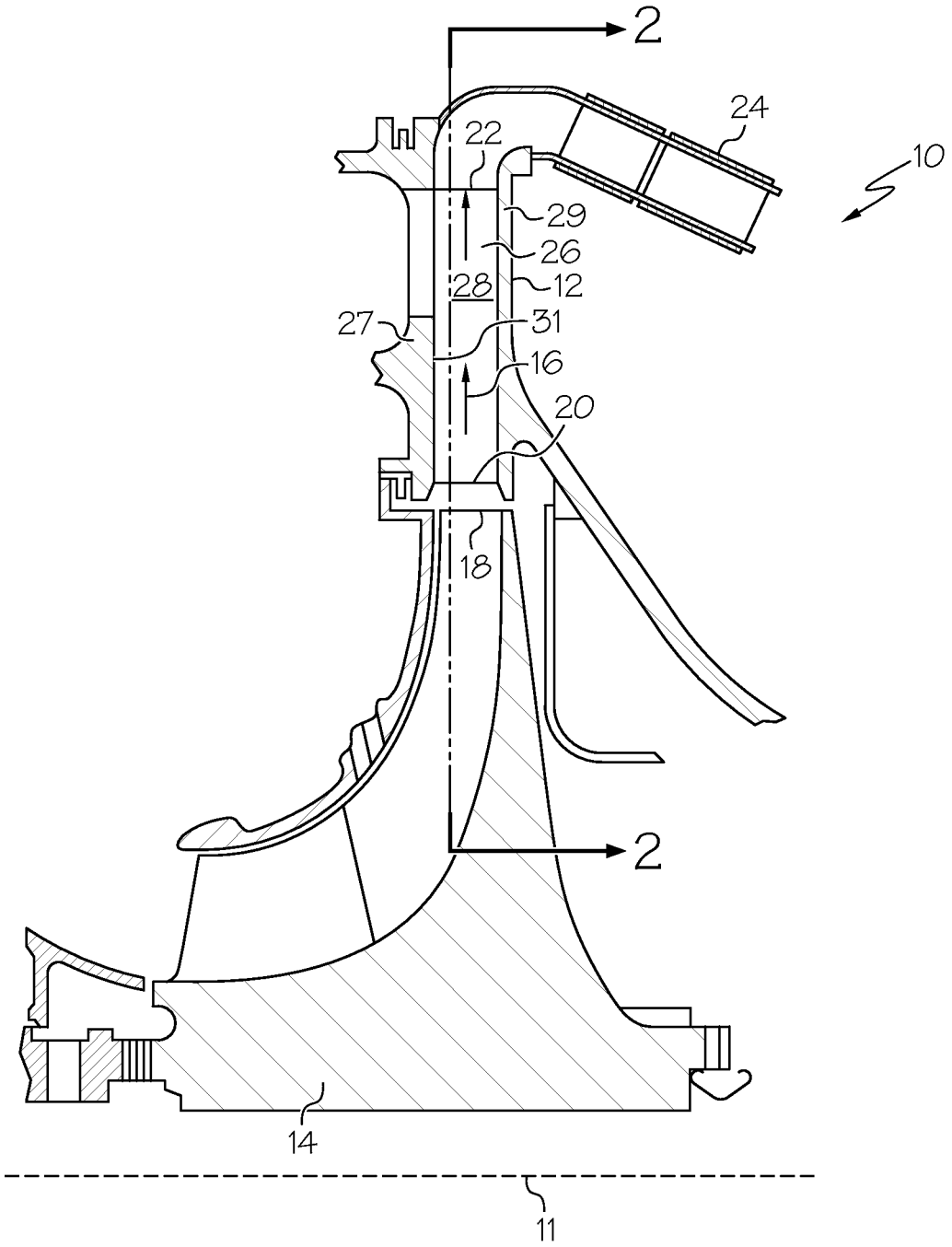
FIG. 1 is a partial cross-sectional side view of a portion of a centrifugal compressor including an impeller and a diffuser in accordance with an embodiment.
Figure 2:
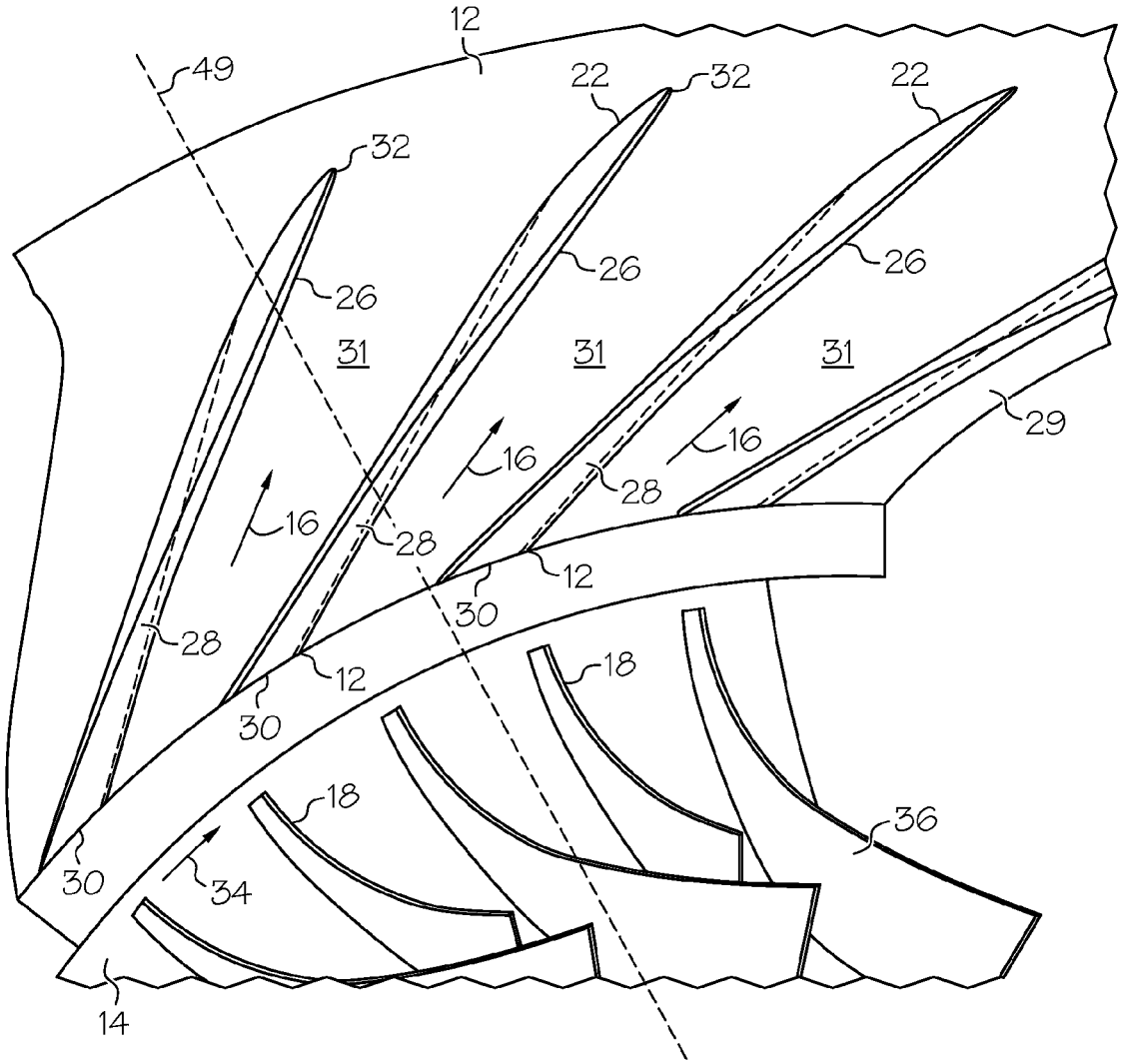
FIG. 2 is a schematic side view of an impeller having impeller vanes and a diffuser having twisted diffuser vanes as a final diffuser design taken along line 2-2 of FIG. 1.
Figure 3:
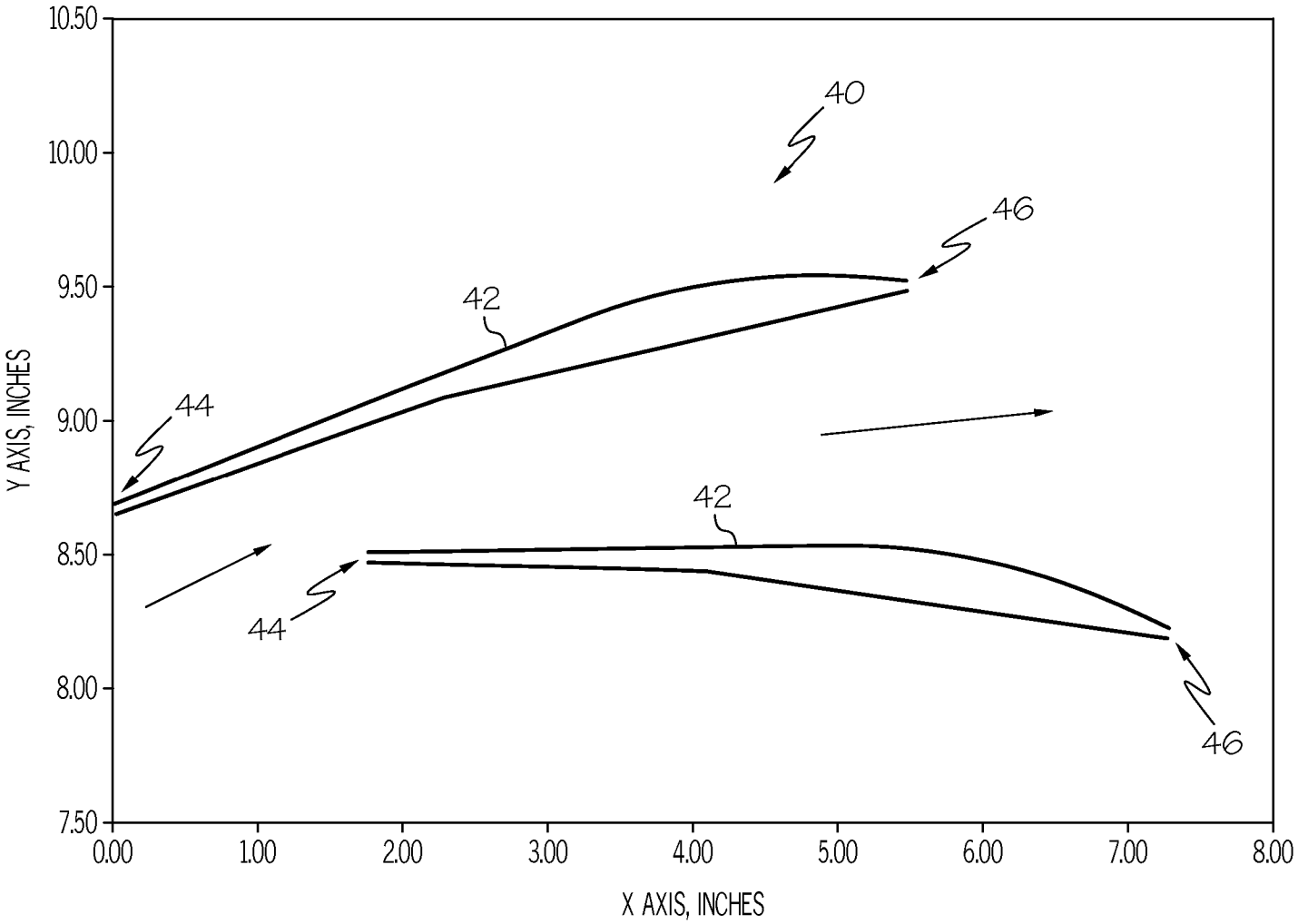
FIG. 3 is a schematic view of an initial two-dimensional diffuser vane layout including initial diffuser vane peripheries.

An exemplary embodiment of a centrifugal compressor 10 will now be described with reference to FIGS. 1 and 2. Referring to FIG. 1, a portion of a centrifugal compressor 10 is shown. The centrifugal compressor 10 includes a diffuser 12 and an impeller 14, with the impeller 14 concentrically rotatable relative to the diffuser 12 about an axis 11. In particular, the diffuser 12 is positioned radially outward about the impeller 14 and is centered on the axis 11. Airflow 16 that is provided from an impeller exit 18 is in flow communication with the diffuser 12. The diffuser 12 includes a diffuser inlet 20 and a diffuser outlet 22, with diffuser vanes 26 that are connected between a shroud 27 and a hub 29. The "shroud", as referred to herein, is a forward wall of the diffuser 12 relative to an inlet (not shown) into the centrifugal compressor 10. The "hub", as referred to herein, is a rearward wall of the diffuser 12 relative to the inlet into the centrifugal compressor 10. The diffuser vanes 26 include diffuser vane surfaces 28 that extend between the shroud 27 and the hub 29. In particular, the diffuser vane surfaces 28 include shroud connections located axially forward toward an inlet of the centrifugal compressor 10 and hub connections located axially aft of the shroud 27 such that the diffuser vane surfaces 28 are physically attached to the shroud 27 and the hub 29. The shroud 27, the hub 29, and the diffuser vanes 26 define airflow channels 31, as shown in FIGS. 1 and 2. Referring again to FIG. 1, the diffuser inlet 20 is adjacent to the impeller exit 18 and permits airflow 16 to exit the impeller 14 serially into the diffuser 12. In an embodiment and as shown in FIG. 1, the shroud 27 and the hub 29 have equal leading edge radii, although it is to be appreciated that in other embodiments and although not shown, the shroud 27 and the hub 29 may have different leading edge radii. Different leading edge radii of the shroud and the hub could be employed to increase or decrease diffuser vane circumferential lean and to allow airflow to first encounter a leading edge of the diffuser vanes at the hub or shroud, whichever has a lower radius. A deswirl cascade 24 is in flow communication with diffuser 12 and extends from the diffuser outlet 22 to provide compressed air from the centrifugal compressor 10, such as to a downstream combustor (not shown).

Referring to FIG. 2, exemplary features of the diffuser 12 and the impeller 14 are shown in further detail. The diffuser 12 of the embodiment shown in FIG. 2 includes diffuser vanes 26 that are radially spaced about the axis 11. By "radially spaced", it is meant that the diffuser vanes 26 are circumferentially spaced about the axis 11 in a spoke-like manner to provide airflow channels 31 about a rotational circumference of the impeller 14. As shown in FIG. 2, the diffuser vanes 26 are generally tangentially angled relative to the rotational circumference of the impeller 14. The diffuser vanes 26 have leading edges 30 that are proximal to the axis 11, and trailing edges 32 that are distal to the axis 11. More specifically, the leading edges 30 adjacent to the impeller 14 and are closer to the axis 11 than the trailing edges 32. As shown in FIG. 2 and as described in further detail below, the diffuser vanes 26 have a twisted configuration extending from the leading edges 30 to the trailing edges 32, which more closely aligns the shape of the diffuser vanes 26 to a profile of the airflow 16 provided by the impeller 14 than diffuser vanes (not shown) that do not have a twisted configuration. By "twisted configuration" as referred to herein, it is meant that the diffuser vane surfaces 28 form a variable angle with the shroud 27 and the hub 29, respectively, from the leading edge 30 to the trailing edge 32. In an embodiment and as shown in FIG. 2, the leading edges 30 are skewed relative to a radius 49 of the diffuser 12. For example, the leading edges 30 form less than a 90 degree angle with the radius 49 of the diffuser 12. In an embodiment, the leading edges 30 are skewed at a first angle relative to the radius 49 of the diffuser 12 of from about 50 to about 85 degrees, such as from about 60 to about 85 degrees. In this embodiment, the leading edges 30 are skewed in an opposite direction to a direction of rotation 34 of the impeller 14 relative to the diffuser 12, as viewed at a perspective 2-2 from the shroud 27 to the hub 29. In the embodiment shown in FIG. 2, the trailing edges 32 of the diffuser vanes 26 form about a 90 degree angle with the shroud 27 and the hub 29, which provides aerodynamic sweep to the leading edge 30 to thereby maximize aerodynamic performance of the centrifugal compressor 10 and potentially minimize mechanical excitation of impeller vanes 36 of the impeller 14.

An embodiment of an exemplary method of designing the diffuser vanes 26 having the twisted configuration, as shown in FIG. 2, will now be described with reference to FIGS. 3-6. In accordance with an embodiment and referring to FIG. 3, an initial two-dimensional diffuser vane layout 40 is provided including initial diffuser vane peripheries 42 that are radially spaced about an axis, such as the axis 11 as shown in FIG. 1. The initial two-dimensional diffuser vane layout 40, as referred to herein, is a layout of initial diffuser vanes in two dimensions and represents a configuration of the initial diffuser vanes as viewed along line 2-2 in FIG. 1. In accordance with an embodiment, the initial two-dimensional diffuser vane layout 40 is created by a computer processor using conventional drafting software. The initial diffuser vane peripheries 42 represent straight diffuser vanes, i.e., untwisted diffuser vanes, that provide a starting point for generating the diffuser vanes 26 having the twisted configuration as shown in FIG. 2. In this regard, the initial diffuser vane peripheries 42 may represent connection configurations of initial diffuser vanes to the shroud and the hub, since the connection configurations for straight diffuser vanes to the shroud and the hub are the same (whereas connection configurations of twisted diffuser vanes to the shroud and the hub are different, as described below). The initial diffuser vane peripheries 42 extend between leading ends 44 and trailing ends 46 thereof, with the leading ends 44 and trailing ends 46 located as described above in the context of the leading edges 30 and trailing edges 32 of FIG. 2, the difference being that the leading ends 44 and trailing ends 46 do not represent edges but rather a two-dimensional point in the initial diffuser vane peripheries 42.

Figure 4:
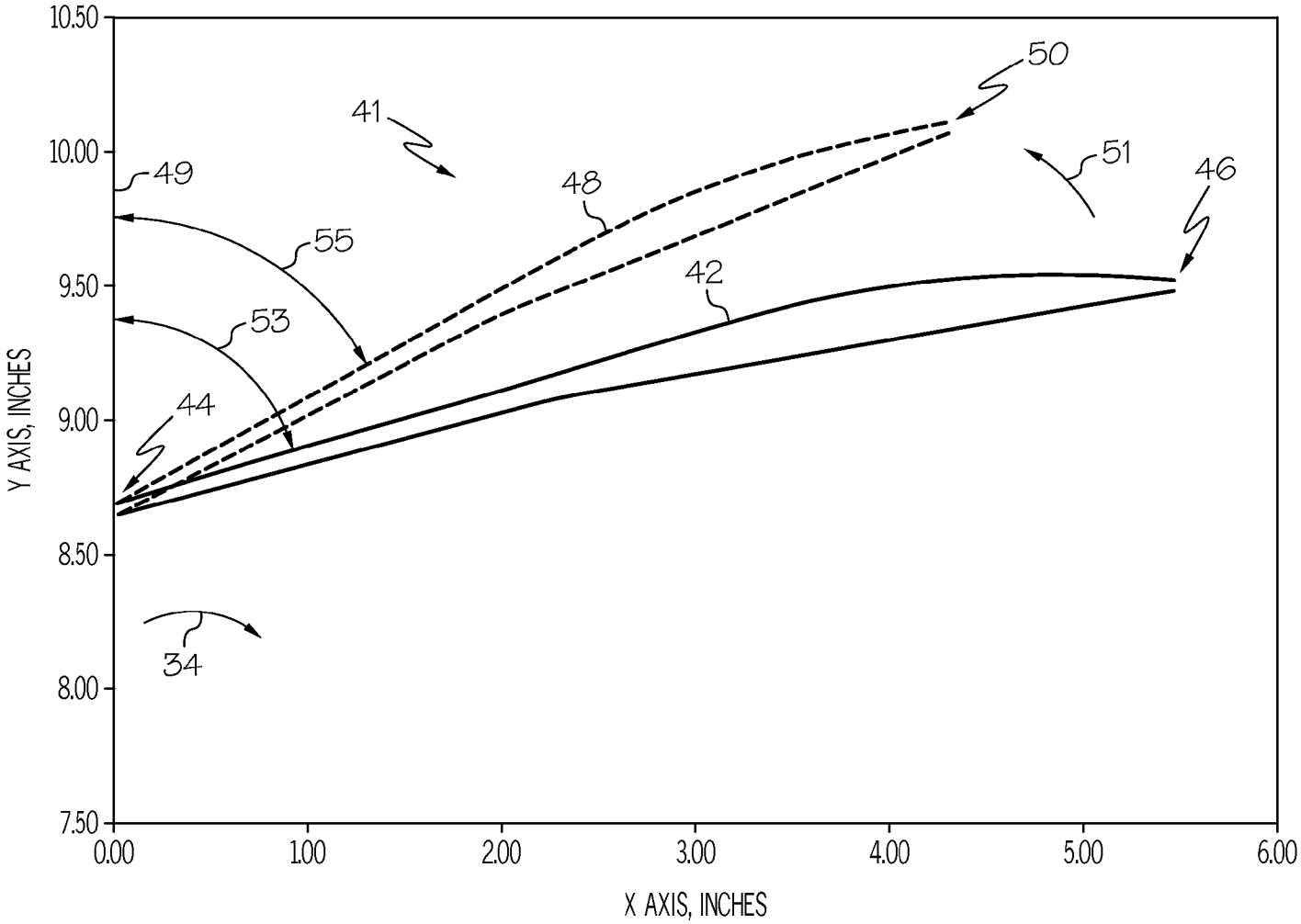
FIG. 4 is a schematic view of the two-dimensional diffuser vane layout including the initial diffuser vane periphery as shown in FIG. 3 and with the initial diffuser vane periphery modified to produce a rotated diffuser vane periphery.

Referring to FIG. 4, the initial diffuser vane peripheries 42 are rotated using the computer processor to produce rotated diffuser vane peripheries 48 having offset trailing ends 50 relative to trailing ends 46 of the initial diffuser vane peripheries 42. In an embodiment and as shown in FIG. 4, the initial diffuser vane peripheries 42 are rotated about the respective leading ends 44 thereof to produce the rotated diffuser vane peripheries 48 that have common leading ends 44 with the initial diffuser vane peripheries 42, i.e., the initial diffuser vane peripheries 42 are pivoted about the leading ends 44 thereof to form the rotated diffuser vane peripheries 48. In other embodiments and although not shown, it is to be appreciated that the initial diffuser vane peripheries 42 may be rotated about a point contained within the initial diffuser vane peripheries other than the leading ends 44 thereof, in which can the leading ends 44 of the rotated diffuser vane peripheries 48 will have offset leading ends (not shown) with the initial diffuser vane peripheries 42. In an embodiment and as shown in FIG. 4, the initial diffuser vane peripheries 42 are rotated in a rotation direction 51 that is opposite to a direction of rotation 34 of the impeller relative to the diffuser to produce the rotated diffuser vane peripheries 48, such as opposite to the direction of rotation 34 of the impeller 14 relative to the diffuser 12 as shown in FIG. 2. As alluded to above, the resulting rotated diffuser vane peripheries 48 have offset trailing ends 50 relative to trailing ends 46 of the initial diffuser vane peripheries 42. "Offset trailing ends", as referred to herein, are trailing ends 50 of the rotated diffuser vane peripheries 48 that have a displaced alignment from the trailing ends 46 of the initial diffuser vane peripheries 42 in the modified two-dimensional diffuser vane layout 41 such that the offset trailing ends 50 do not completely overlie the trailing ends 46 of the initial diffuser vane peripheries 42 in a modified two-dimensional diffuser vane layout 41. A degree of rotation of the initial diffuser vane peripheries 42 may vary based upon design considerations and, particular, based upon a degree of twisting that final diffuser vanes are to exhibit. In an embodiment, the initial diffuser vane peripheries 42 are rotated to an angle of from greater than 0 to about 30 degrees, measured as the difference between an initial angle 53 of the initial diffuser vane periphery 42 and a final angle of the rotated diffuser vane periphery 42, to produce the rotated diffuser vane peripheries 48. An extent of rotation of the initial diffuser vane peripheries 42 controls a skew angle of the leading edge to the radius 49 of the diffuser, which is shown on the Y axis in FIG. 4. In particular, the final angle 55 of the rotated diffuser vane peripheries 52 controls the skew angle of the leading edge to the radius 49 of the diffuser.

Figure 5:
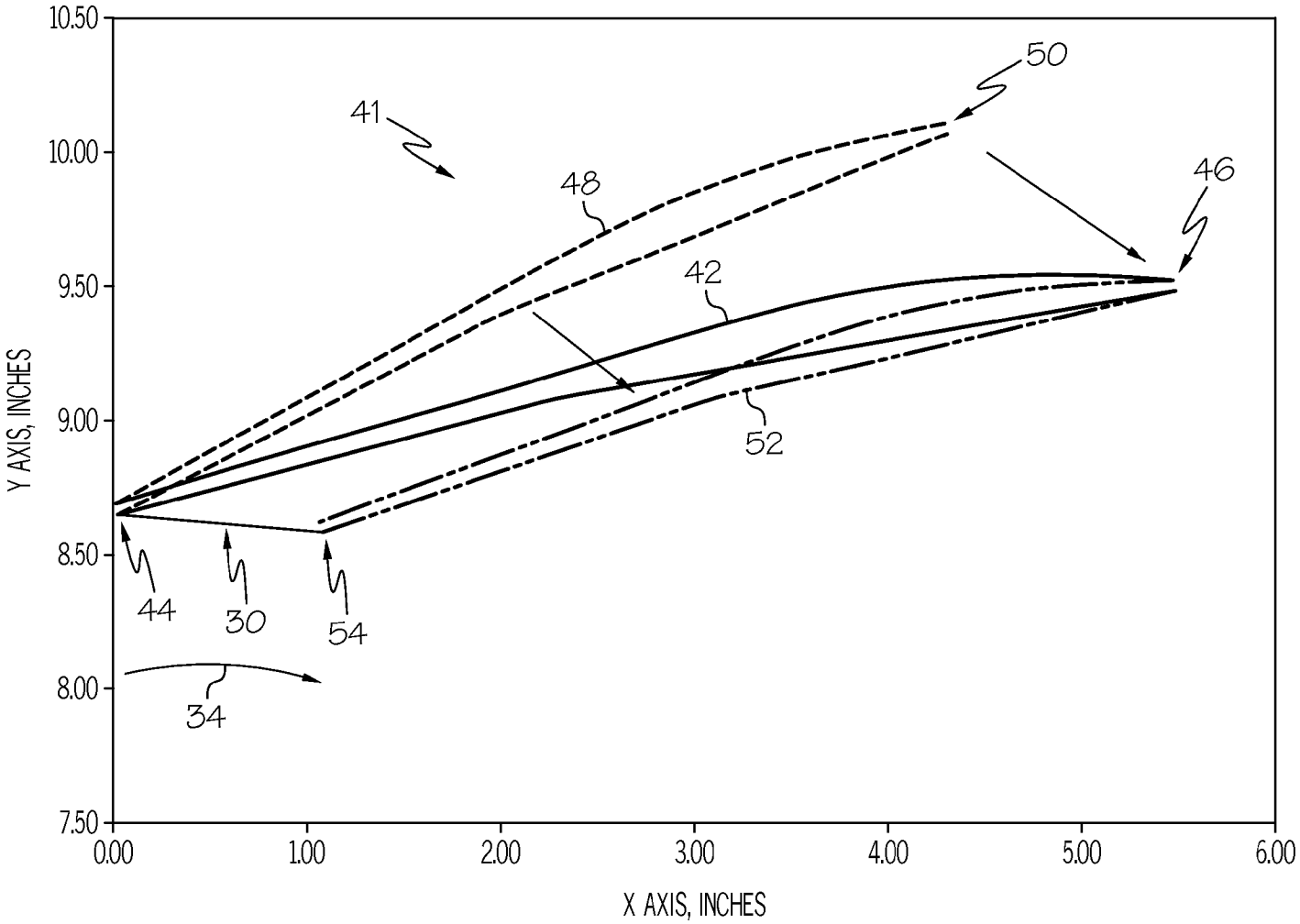
FIG. 5 is a schematic view of the two-dimensional diffuser vane layout including the initial diffuser vane periphery as shown in FIG. 3 and the rotated diffuser vane periphery as shown in FIG. 4, and with the rotated diffuser vane periphery shifted to produce a shifted diffuser vane periphery.

Referring to FIG. 5, the rotated diffuser vane peripheries 48 are circumferentially shifted about the axis (shown at 11 in FIG. 1) using the computer processor to produce shifted diffuser vane peripheries 52. "Circumferentially shifting", as referred to herein, means that the rotated diffuser vane peripheries 48 are moved in an arcuate path about the axis 11 without rotating the rotated diffuser vane peripheries 48 about either the leading ends 44 or the trailing ends 50 of the rotated diffuser vane peripheries 48. In this regard, the rotated diffuser vane peripheries 48 are shifted at a maintained angle of the rotated diffuser vane peripheries 48 to produce the shifted diffuser vane peripheries 52 at a parallel orientation to the rotated diffuser vane peripheries 48, thereby maintaining an angle of rotation of the rotated diffuser vane peripheries 48 relative to the initial diffuser vane peripheries 42 in the shifted diffuser vane peripheries 52. The rotated diffuser vane peripheries 48 are circumferentially shifted to introduce the twisted configuration to the resulting diffuser vanes by varying displacement between the initial diffuser vane peripheries 42 and the shifted diffuser vane peripheries 52. Whereas the degree of rotation of the initial diffuser vane peripheries 42 to produce the rotated diffuser vane peripheries 48 controls a degree of twisting in the resulting diffuser vanes, a degree of circumferential shifting of the rotated diffuser vane peripheries 48 controls leading edge and trailing edge configurations in the resulting diffuser vane peripheries. Further, the rotated diffuser vane peripheries 48 are shifted in the direction of rotation 34 of the impeller relative to the diffuser for purposes of forming the resulting diffuser vanes 26 with the skewed leading edge 30 as described above and as shown in FIGS. 5 and 6. In an embodiment and as shown in FIG. 5, leading ends 54 of the shifted diffuser vane peripheries 52 are offset from the leading ends 44 of the initial diffuser vane peripheries 42, thereby resulting in the skewed leading edges 30 of the resulting diffuser vanes 26. In an embodiment and as shown in FIG. 5, the rotated diffuser vane peripheries 48 are circumferentially shifted with the trailing ends 50 of the rotated diffuser vane peripheries 48 moved to a location between the trailing ends 50 of the rotated diffuser vane peripheries 48 and the trailing ends 46 of the corresponding initial diffuser vane peripheries 42, including the location of the trailing ends 46 of the corresponding initial diffuser vane peripheries 42. In particular, in an embodiment, the rotated diffuser vane peripheries 48 are circumferentially shifted to align the trailing ends 50 of the rotated diffuser vane peripheries 48 and the trailing ends 46 of the corresponding initial diffuser vane peripheries 42 to produce the shifted diffuser vane peripheries 52 for purposes of forming the trailing edges 32 of the diffuser vanes 26 having the angle of about 90 degrees with the shroud 27 and with the hub 29 (as shown in FIG. 2). By "aligning" the trailing ends 50 of the rotated diffuser vane peripheries 48 and the trailing ends 46 of the initial diffuser vane peripheries 42, it is meant that the respective trailing ends 46, 50 are generally overlaid in the modified two-dimensional diffuser vane layout 41, as shown in FIG. 5.

Figure 6:
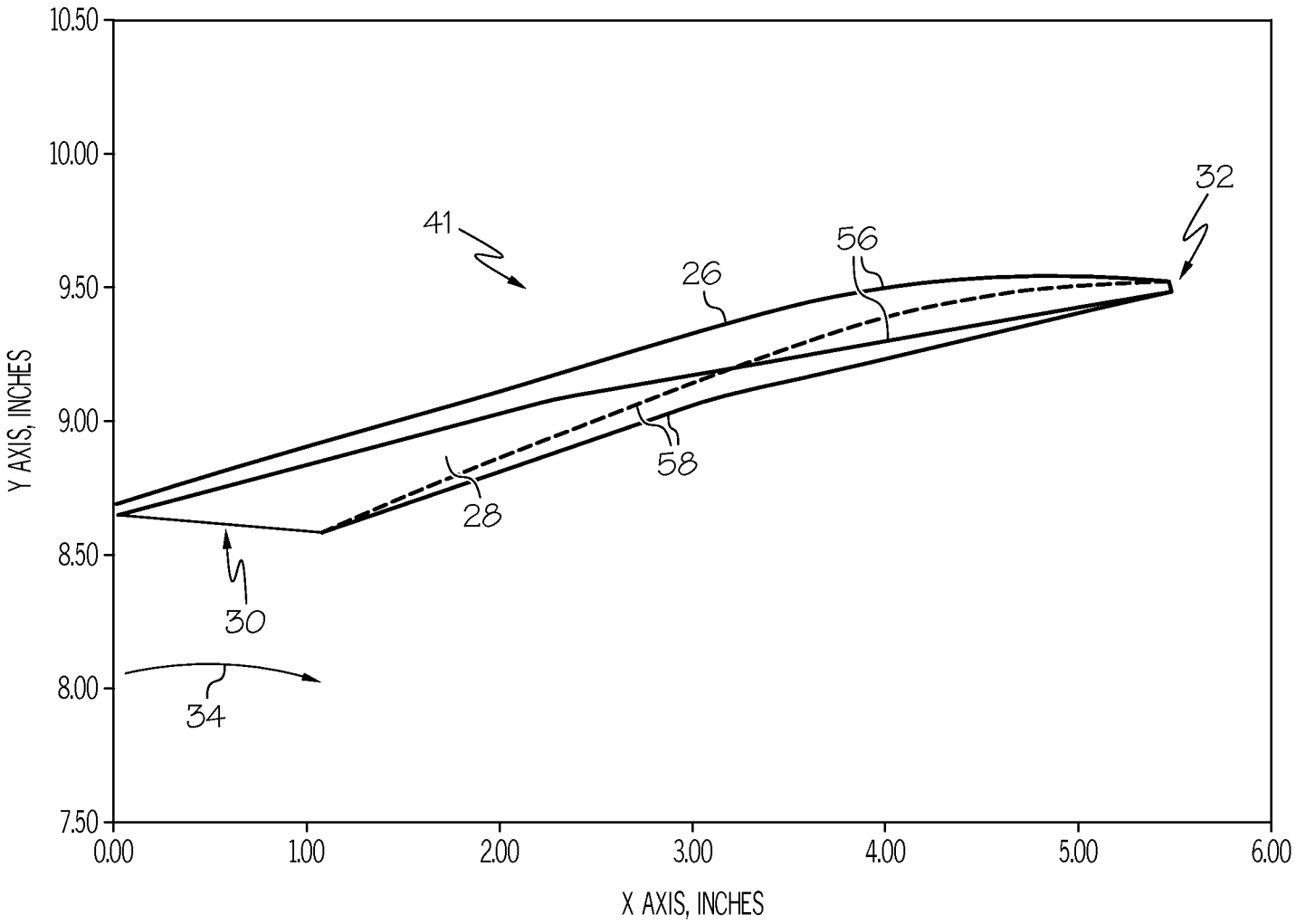
FIG. 6 is a schematic view of a now three-dimensional diffuser vane layout including diffuser vanes generated from the initial diffuser vane periphery and the shifted diffuser vane periphery to form a diffuser vane in a twisted configuration.

Referring to FIG. 6, after producing the shifted diffuser vane peripheries, diffuser vane surfaces 28 are generated to connect the shifted diffuser vane peripheries to the corresponding initial diffuser vane peripheries using the computer processor to form diffuser vanes 26 in a twisted configuration extending from leading edges 30 to trailing edges 32. In an embodiment and as shown in FIG. 6, the diffuser vane surfaces 28 are generated to have a shroud connection 56 and a hub connection 58, with the initial diffuser vane periphery representing the shroud connection 56 for the diffuser vane surfaces 28 and with the shifted diffuser vane periphery representing the hub connection 58 for the diffuser vane surfaces 28. In the embodiment shown in FIG. 6, due to the alignment between the trailing ends 46, 50 of the shifted diffuser vane periphery and the initial diffuser vane periphery, the diffuser vane 26 has the trailing edge 32 that forms the angle of about 90 degrees with the shroud 27 and the hub 29. Also in this embodiment, due to the offset between the leading ends 44, 54 of the shifted diffuser vane periphery and the initial diffuser vane periphery, the leading edge 30 is skewed relative to the radius 49 of the diffuser 12 as described above and as also shown in FIG. 2. All diffuser vanes 26 in the diffuser 12 may be simultaneously or sequentially designed using the computer processor, with the same conditions applied for rotation of the initial diffuser vane peripheries and shifting of the rotated diffuser vane peripheries to produce the diffuser vanes 26. The resulting diffuser vane 26 shown in FIG. 6 can be implemented into a physical structure using the now three-dimensional diffuser vane layout 41 to produce the diffuser 12 that includes diffuser vanes 26 in the twisted configuration. Referring again to FIG. 1, the resulting diffuser 12 and the impeller 14 may be assembled to produce the centrifugal compressor 10.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A method of designing and making diffuser vanes in a centrifugal compressor comprising a diffuser and an impeller concentrically rotatable relative to the diffuser about an axis, the method comprising:

providing an initial two-dimensional diffuser vane layout including initial diffuser vane peripheries radially spaced about the axis;

rotating the initial diffuser vane peripheries using a computer processor to produce rotated diffuser vane peripheries having offset trailing ends relative to trailing ends of the initial diffuser vane peripheries, wherein rotating the initial diffuser vane peripheries comprises rotating the initial diffuser vane peripheries about leading ends opposite to a direction of rotation of the impeller relative to the diffuser to produce the rotated diffuser vane peripheries;

circumferentially shifting the rotated diffuser vane peripheries about the axis using the computer processor to produce shifted diffuser vane peripheries, wherein leading ends of the shifted diffuser vane peripheries are offset from the leading ends of the initial diffuser vane peripheries;

generating diffuser vane surfaces connecting the shifted diffuser vane peripheries to the corresponding initial diffuser vane peripheries using the computer processor to form diffuser vanes in a twisted configuration extending from leading edges to trailing edges;

forming the diffuser including the diffuser vanes in the twisted configuration; and assembling the diffuser and the impeller concentrically rotatable relative to the diffuser about the axis.

2. The method of claim 1, wherein circumferentially shifting the rotated diffuser vane peripheries about the axis comprises shifting the rotated diffuser vane peripheries at a maintained angle of the rotated diffuser vane peripheries to produce the shifted diffuser vane peripheries at a parallel orientation to the rotated diffuser vane peripheries.

3. The method of claim 1, wherein the diffuser vane surfaces comprise shroud connections to a shroud located axially forward toward an inlet of the centrifugal compressor and hub connections located axially aft of the shroud, and wherein generating the diffuser vane surfaces comprises generating the diffuser vane surfaces having the shroud connections and the hub connections.

4. The method of claim 3, wherein the initial diffuser vane peripheries represent the shroud connections for the diffuser vane surfaces, and wherein generating the diffuser vane surfaces comprises generating the diffuser vane surfaces with the initial diffuser vane peripheries representing the shroud connections for the diffuser vane surfaces.

5. The method of claim 3, wherein the shifted diffuser vane peripheries represent the hub connections for the diffuser vane surfaces, and wherein generating the diffuser vane surfaces comprises generating the diffuser vane surfaces with the shifted diffuser vane peripheries representing the hub connections for the diffuser vane surfaces.

6. The method of claim 1, wherein circumferentially shifting the rotated diffuser vane peripheries comprises aligning the trailing ends of the rotated diffuser vane peripheries and the trailing ends of the corresponding initial diffuser vane peripheries to produce the shifted diffuser vane peripheries.

7. The method of claim 6, wherein generating the diffuser vane surfaces comprises generating the diffuser vane surfaces with the trailing edges of the diffuser vanes forming a 90 degree angle with a shroud and a hub.

8. The method of claim 6, wherein generating the diffuser vane surfaces comprises generating the diffuser vane surfaces with leading edges of the diffuser vanes skewed relative to a radius of the diffuser.

9. The method of claim 6, wherein generating the diffuser vane surfaces comprises generating the diffuser vane surfaces with the leading edges of the diffuser vanes skewed in an opposite direction to a direction of rotation of the impeller relative to the diffuser.

10. The method of claim 6, wherein generating the diffuser vane surfaces comprises generating the diffuser vane surfaces with the leading edges of the diffuser vanes skewed at a first angle relative to a radius of the diffuser of from 50 to 85 degrees.

11. The method of claim 1, wherein circumferentially shifting the rotated diffuser vane peripheries comprises circumferentially shifting the rotated diffuser vane peripheries in the direction of rotation of the impeller relative to the diffuser.

12. The method of claim 11, wherein circumferentially shifting the rotated diffuser vane peripheries comprises circumferentially shifting the rotated diffuser vane peripheries with the trailing ends of the rotated diffuser vane peripheries moved to a location between the trailing ends of the rotated diffuser vane peripheries and the trailing ends of the corresponding initial diffuser vane peripheries.

13. The method of claim 12, wherein circumferentially shifting the rotated diffuser vane peripheries comprises aligning the trailing ends of the rotated diffuser vane peripheries and the trailing ends of the corresponding initial diffuser vane peripheries to produce the shifted diffuser vane peripheries.

14. A method of designing and making diffuser vanes in a centrifugal compressor comprising a diffuser and an impeller concentrically rotatable relative to the diffuser about an axis, the method comprising:

providing an initial two-dimensional diffuser vane layout including initial diffuser vane peripheries radially spaced about the axis;

rotating the initial diffuser vane peripheries using a computer processor to produce rotated diffuser vane peripheries having offset trailing ends relative to trailing ends of the initial diffuser vane peripheries;

circumferentially shifting the rotated diffuser vane peripheries about the axis using the computer processor to produce shifted diffuser vane peripheries, wherein leading ends of the shifted diffuser vane peripheries are offset from the leading ends of the initial diffuser vane peripheries, and wherein circumferentially shifting the rotated diffuser vane peripheries about the axis comprises shifting the rotated diffuser vane peripheries at a maintained angle of the rotated diffuser vane peripheries to produce the shifted diffuser vane peripheries at a parallel orientation to the rotated diffuser vane peripheries;

generating diffuser vane surfaces connecting the shifted diffuser vane peripheries to the corresponding initial diffuser vane peripheries using the computer processor to form diffuser vanes in a twisted configuration extending from leading edges to trailing edges;

forming the diffuser including the diffuser vanes in the twisted configuration; and assembling the diffuser and the impeller concentrically rotatable relative to the diffuser about the axis.

15. A method of designing and making diffuser vanes in a centrifugal compressor comprising a diffuser and an impeller concentrically rotatable relative to the diffuser about an axis, the method comprising:

providing an initial two-dimensional diffuser vane layout including initial diffuser vane peripheries radially spaced about the axis;

rotating the initial diffuser vane peripheries using a computer processor to produce rotated diffuser vane peripheries having offset trailing ends relative to trailing ends of the initial diffuser vane peripheries;

circumferentially shifting the rotated diffuser vane peripheries about the axis using the computer processor to produce shifted diffuser vane peripheries, wherein leading ends of the shifted diffuser vane peripheries are offset from the leading ends of the initial diffuser vane peripheries;

generating diffuser vane surfaces connecting the shifted diffuser vane peripheries to the corresponding initial diffuser vane peripheries using the computer processor to form diffuser vanes in a twisted configuration extending from leading edges to trailing edges, wherein the diffuser vane surfaces comprise shroud connections to a shroud located axially forward toward an inlet of the centrifugal compressor and hub connections located axially aft of the shroud, and wherein generating the diffuser vane surfaces comprises generating the diffuser vane surfaces having the shroud connections and the hub connections;

forming the diffuser including the diffuser vanes in the twisted configuration; and assembling the diffuser and the impeller concentrically rotatable relative to the diffuser about the axis.

16. The method of claim 15, wherein the initial diffuser vane peripheries represent the shroud connections for the diffuser vane surfaces, and wherein generating the diffuser vane surfaces comprises generating the diffuser vane surfaces with the initial diffuser vane peripheries representing the shroud connections for the diffuser vane surfaces.

17. The method of claim 15, wherein the shifted diffuser vane peripheries represent the hub connections for the diffuser vane surfaces, and wherein generating the diffuser vane surfaces comprises generating the diffuser vane surfaces with the shifted diffuser vane peripheries representing the hub connections for the diffuser vane surfaces.

* * * * *